US006824181B2

(12) United States Patent
Samper et al.

(10) Patent No.: US 6,824,181 B2
(45) Date of Patent: Nov. 30, 2004

(54) RETRACTILE GRAB DEVICE FOR THE RECOVERY OF BLOCKS SUBMERGED IN A MARINE ENVIRONMENT

(76) Inventors: Rafael Torres Samper, Urb. Palacio de Meres No. 14, Siero, Asturias (ES); Carlos Fermin Menéndez Diaz, Rey Pelayo 3,2,C, Castrillón, Asturias, Piedras Blancus (ES)

( * ) Notice: Subject to any disclaimer, the term of this patent is extended or adjusted under 35 U.S.C. 154(b) by 41 days.

(21) Appl. No.: 10/231,899

(22) Filed: Aug. 29, 2002

(65) Prior Publication Data

US 2003/0042748 A1 Mar. 6, 2003

(30) Foreign Application Priority Data

Aug. 30, 2001 (ES) ..... P200101992

(51) Int. Cl.[7] ..... B66C 3/04
(52) U.S. Cl. ..... 294/112; 294/66.1
(58) Field of Search ..... 294/111, 112, 294/66.1, 66.2, 106, 110.1; 37/182, 340

(56) References Cited

U.S. PATENT DOCUMENTS

| | | | | | |
|---|---|---|---|---|---|
| 1,587,479 | A | * | 6/1926 | Durocher | 294/112 |
| 1,964,905 | A | * | 7/1934 | Butterworth | 294/112 |
| 1,988,135 | A | * | 1/1935 | Odman | 294/112 |
| 2,052,211 | A | * | 8/1936 | Botten | 294/112 |
| 3,099,476 | A | * | 7/1963 | Miller | 294/112 |
| 4,807,918 | A | * | 2/1989 | Weeks | 294/110.1 |

* cited by examiner

*Primary Examiner*—Dean J. Kramer
(74) *Attorney, Agent, or Firm*—Power Del Valle LLP

(57) ABSTRACT

A retractile grab device, suitable for extracting and recovering submerged concrete blocks which form part of the protective structure at harbours and marine docks. The device of the present invention operates with a crane or similar mechanical driving apparatus that supports it and from which the operating tasks are performed, and is capable of executing a prehensile movement between its claw elements, whereby it takes firm hold of a submerged block and raises and deposits it any chosen place.

2 Claims, 2 Drawing Sheets

RETRACTILE GRAB DEVICE FOR THE RECOVERY OF BLOCKS SUBMERGED IN A MARINE ENVIRONMENT

A retractile grab device, suitable for extracting and recovering submerged concrete blocks which form part of the protective structure at harbours and marine docks. The device of the present invention operates with a crane or similar mechanical driving means that supports it and from which the operating tasks are performed, and is capable of executing a prehensile movement between its claw elements, whereby it takes firm hold of a submerged block and raises and deposits it any chosen place.

The construction of protective dikes and counterdikes at harbours and marine docks has always been done on a permanent basis in view of the enormous effort and high costs involved in removing the thousands of large-sized rocks or concrete blocks that usually make up facilities of this type. Nevertheless, either because of the strategic location of the harbour, the existing network of logistic infrastructure in the area, the proximity of a series of industrial plants that make use of it, the lack of a suitable nearby place for the construction of a new port, or for any other reasons, when the decision is made to enlarge a port, it usually becomes necessary to withdraw a part or all of those immense and diverse structures forming the protective dike. In this removal operation, as a rule, it is necessary to extract the loose materials forming the core of the structure, as well as the large rocks or concrete blocks which, with their prismatic or similar constitution, usually form the layer protecting and sheltering the structure from the action of the sea and which make up its rockfill.

The procedures used nowadays for the partial removal of blocks which have normally been randomly put in place are arduous, entailing manual labour, a high risk for the operators doing the job, and an extremely high cost, due to the fact that thousands of blocks typically need to be moved.

One of the procedures used for operations of this type consists of one or more operators submerging and placing a grappling chain or a polyester sling around a block so that it may then be lifted. This procedure is then repeated for each block.

Another method used in these operations is to drill holes in the blocks, also done by submerged operators, and then secure rods in them with resin so that they may be grasped and lifted.

But as it will be readily appreciated, these substantially manual procedures are extremely costly, as in the best of cases the outputs obtained per working day do not exceed the withdrawal of between five and fifteen blocks. In most cases, then, the work requires an inordinate amount of time, which generally results in completion of only partial removal operations being carried out.

In view of the foregoing, as well as many other drawbacks well known in the art, the present invention has been devised.

One purpose of the invention is to provide a suitable device for the recovery of the blocks forming this sheltering structure, which device is capable of acting individually on the blocks to be removed and of lifting them out irrespective of the position they are in. The device of the present invention can perform this task without having to determine the specific location and placement of the blocks beforehand, and carries it out by mere trial and error in an extraordinarily short time compared with the times spent on the procedures used currently and with a success rate in this trial and error process that is close to one hundred percent.

Another important aim hereof is to provide a device, wherein the work of extracting the blocks does not involve manual labour at all, except for the operator controlling the crane supporting the device. This is the same person who controls the inventive device, so there is no risk of injury during the block extraction process.

A further aim of the device is to provide a device as described, in which all the constituent parts are purely mechanical, conferring upon it a strength in keeping with the aggressive environment in which its work will be performed, being moreover suitable to adapt itself perfectly and to work with the vast majority of tractor means used for this type of work.

Yet another object, equally important for the impact on the surrounding environment, is that the device is designed to recover the blocks without impairing their basic characteristics, so that they may be put to use again in any new structure. This is significant not only because of the recovery of the materials involved—a savings which it may be readily appreciated is substantial—but because it avoids a wide range of environmental problems which are entailed in concrete making processes, as experts on the matter are fully aware.

Another object of the invention is to provide a simple and versatile device in which its general structural principles facilitate a practical embodiment for use with blocks of widely varying weight and mass, as it is possible to build a device suitable for handling cubic, prismatic or any amorphous-shaped blocks from one metric ton or less up to a device able to move blocks of ninety or one hundred tons of similar shape, which is the range that comprises most of the blocks used in structures of this type, as well as for blocks of any intermediate size, all on the basis of the aforesaid general structural principles defining the invention.

These and other qualities and advantages may be readily appreciated in relation to the accompanying drawings, which show an example of the currently preferred embodiment of the clamp device in question here for the recovery of submerged blocks, from amongst other possible ones, constituted on the basis of the teachings of the present invention, which is offered for predominantly illustrative and never restrictive purposes, and wherein.

Figure 3:
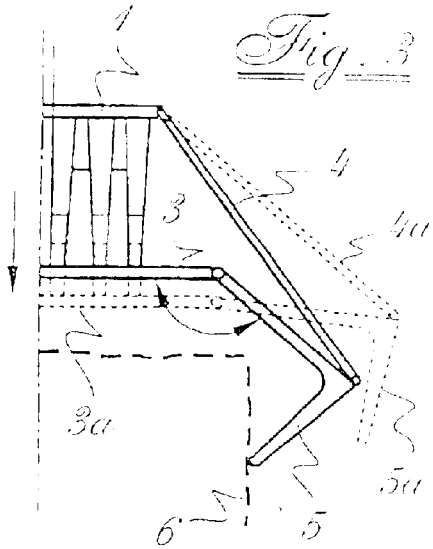
Figure 4:
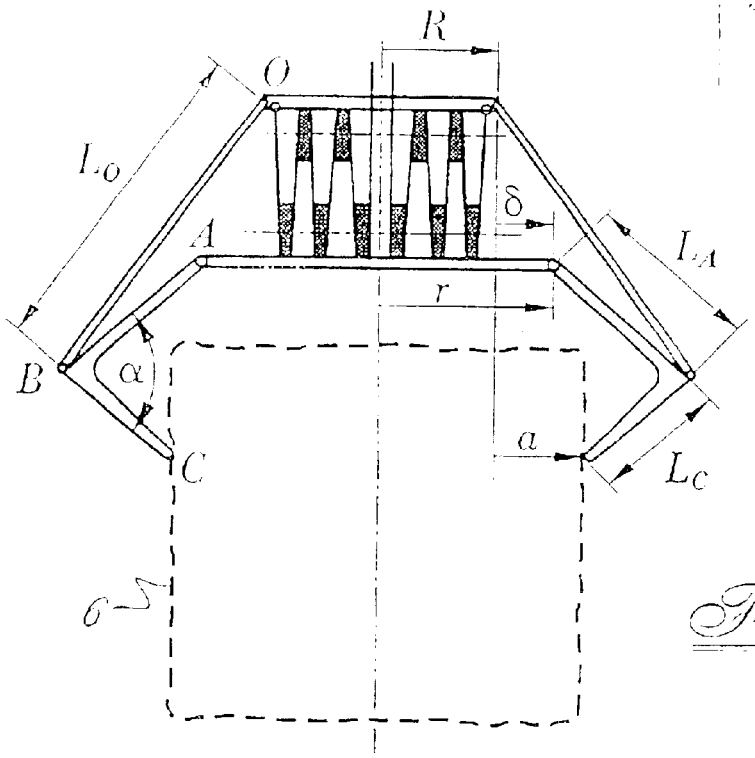

FIG. 3 also shows in a schematic and partial manner the two extreme relative working positions of one of the claw and arm assemblies which make the prehensile means of the device; and FIG. 4 represents the view of a diagram of said grab device in which the most significant parameters generically involved in its constitution are shown and for whatever the capacity of work to be performed, and wherein the two halves represented do not necessarily have to be coplanar, so that said parameters arise in relation to the working load that they supply in the direction of the axis of the device.

Figure 1:
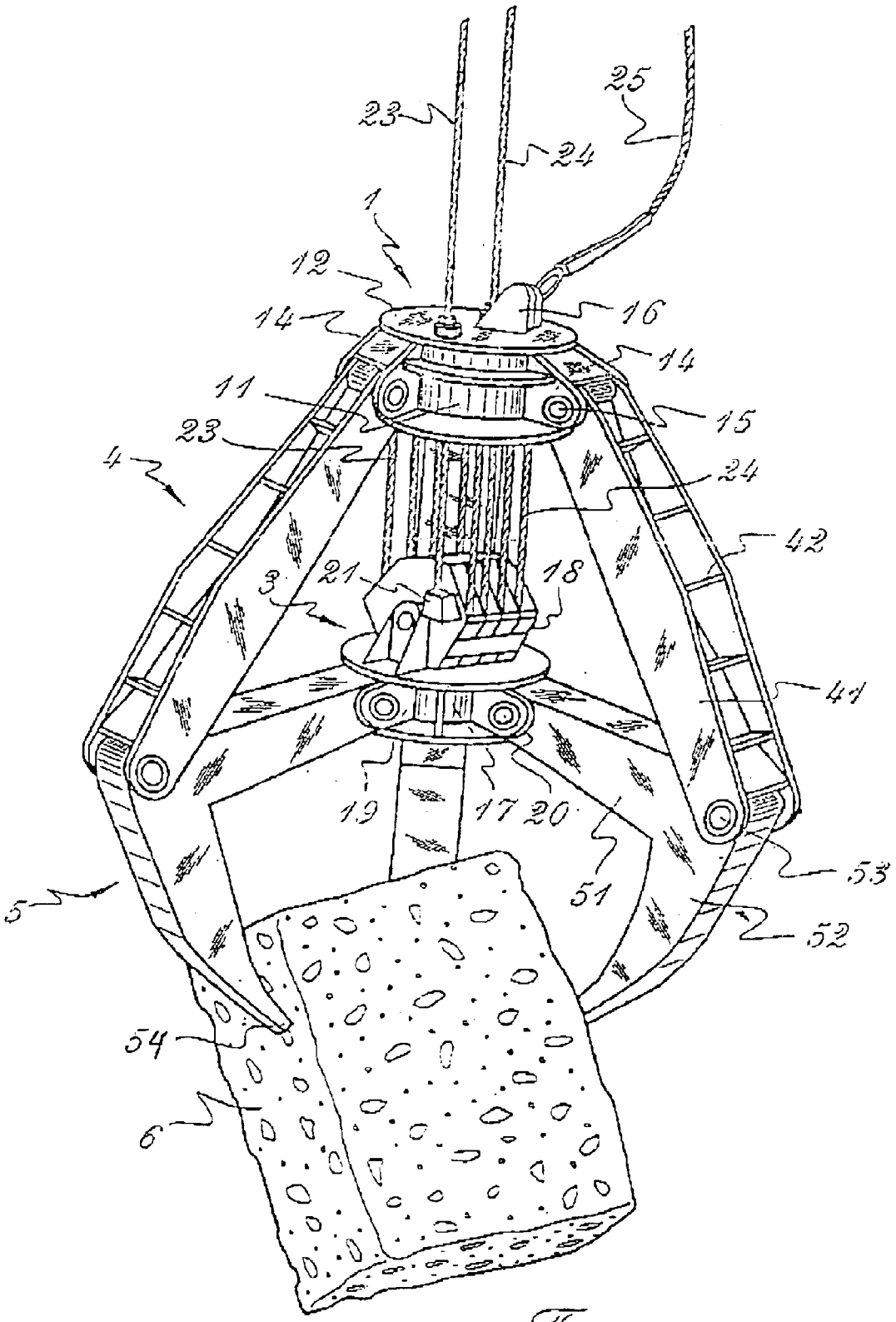
FIG. 1 shows a view, in conventional perspective, of the grab device of the invention, which has grasped a block for removal, in the position of its operational performance, wherein the constitution and arrangement of its parts may be appreciated clearly.
Figure 2:
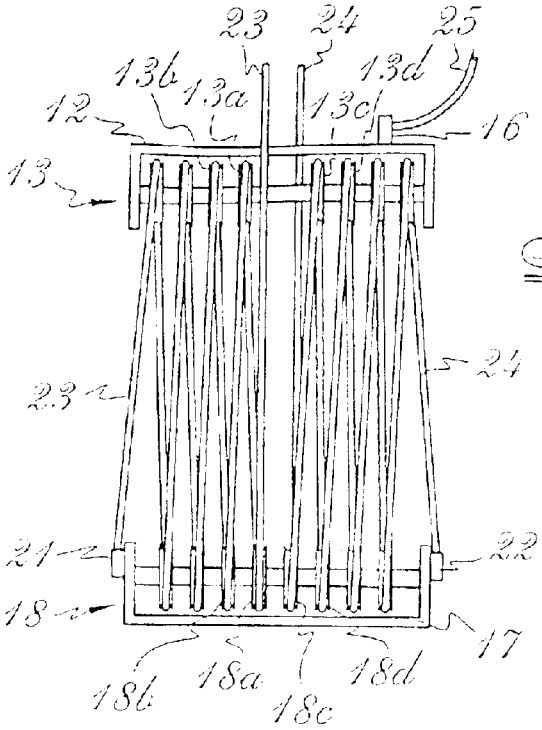
FIG. 2 is a schematic representation of the device opening and closing induction means, wherein its components have been represented slightly apart in order to permit clear understanding of its layout and method of working.

With reference to the drawings, support base 1, made in rolled steel, as are the other items of the device, except for the cables which will be mentioned later, which are of drawn steel, is composed of a body 11, which houses a set of pulleys 13, as shown schematically in FIG. 2, arranged in a bank and in a similar way to and matching up with the set of pulleys 18 that is shown beneath on the induction base 3. The number of pulleys is determined by the size of the working load to be handled. Body 11 is provided with pairs of projecting radial lateral flanges 14, in this case three such pairs, arranged in an equiangular position, suitable for receiving arm elements 4 between them, in the form of a joint, and to permit them to pivot on the shaft 15 that joins them. On the top side of body 11 is an anchoring element 16.

Induction base 3, which is made up of a body 17 on the top surface of which there is a raised set of pulleys 18, arranged in a bank and matching up with the set of pulleys 13 of the support base 1. On the side of body 17 are three equiangular radial transverse projecting pairs of flanges 19, matching up with the pairs of flanges 14 of support base 1. Flanges 19 receive between them, also in the form of a joint, the ends of a claw element 5, and permit it to pivot on the shaft 20 which joins them. Anchoring means 21 and 22, the latter represented in FIG. 2, are attached integrally with each one of the sides of the bearing structure of the pulleys 18.

A pair of cables, 23 and 24, associated with the crane which will control the device, are through-housed on support base 1 until reaching the pulleys 18*a* and 18*c*, respectively. Cable 23 running on up to the upper pulley 13*a*, continuing on down to the lower pulley 18*b*, and so on, in a helical arrangement, until it is firmly secured on the anchoring means 21 of induction base 3. Cable 24, in a similar helical arrangement, runs between the bottom pulley 18*c* and the top pulley 13*c* and from this to the lower one 18*d*, and so on through the rest of the pulleys, until being secured on the anchoring means 22 of the aforesaid induction base 3, so that they together make up a mechanism in the form of a hoist block. A third cable 25, also associated with the crane, is firmly attached to anchor means 16 of support base 1.

A substantially straight arm 4, swivel-jointed to support base 1, is formed of a channel beam structure 41, reinforced with transverse lattice panels 42, and at its free end it is provided with means, in the form of flanges 53, for swivel-jointing to the claw element 5, as described below.

This claw element 5, which, is swivel housed in the flanges 19 of induction base 3, consists of a one piece elbowed element, which has a body portion 51 and a wing portion 52, arranged at a descending angle to the position of the inductor base 3, which holds the claw element 5 and which is provided with anointed tip 54 at its free end. The elbow portion is swivel jointed to the end flanges 53 provided on the arm 4.

In this arrangement, initially cables 23 and 24, associated with a crane, not shown, will hold the grab device statically suspended, so that the weight of the induction base 3 will induce it to move away from support base 1, and the claw elements 5, pivoting on their joint with arm 4, will achieve maximum opening in relation to the other claw elements and to the axis of the assembly.

Then, on exerting traction from the crane on cables 23 and 24, the force of which should not exceed the resistance of the total weight of the grab device assembly, under the effect of the hoist block made up of the set of pulleys, the induction base 3 will approach the support base 1, at the same time causing the claw elements 5 to swivel downwards and move towards the axis of the device and therefore to one another, assisted by the weight of the associated arms 4, so that their tips 54 firmly grasp any element that lies with their scope, such as the block 6 in the drawings. If the traction force continues to be exerted on the cables 23 and 24 until it goes beyond the threshold of the resistance offered by the weight of the grab element and the block imprisoned, an upward movement will take place in both, which will enable it to be transferred to any desired place.

Once at the chosen unloading place, it will suffice to cancel the traction on the cables 23 and 24 and leave the assembly suspended statically from cable 25, so that the weight of the block 6 induces the induction base 3 to move away or descend from the support base 1, as indicated by the arrow in FIG. 3, taking it to the position 3*a* defined by dotted lines, whereupon, as there is no resistance, the opening of the claw elements 5 and their associated arms 4 takes place, in the direction of 5*a* and 4*a*, respectively, and, as a consequence, the release of the block 6.

The device described is highly versatile and thus is able to make use of the same structural principles to handle different masses and volumes. But to achieve this, it is necessary to achieve successful combinations of the different parameters inherent in its geometry.

In FIG. 4 R indicates the distance from the axis of the device to the points where the support base 1 is joined to the arms 4, indicated at O; r is the distance from the axis of the device to the points where the induction base 3 is connected to the claw 5, point A; $L_o$ represents the length of the arm 4, between the connecting points of the support base 1 and the arms 4, or distance OB; $L_A$ is the length of the body 51 of the claw elements, AB; $L_C$ represents the length of the wing portion 52 of the claw element 5, or distance BC; $\alpha$ is the angle formed by alignments AB and BC; n, not shown in the drawing, is the gearing ratio due to the pulleys 13 and 18; and P indicates the relative weight per element of claw 5 and the block to be handled; and as ancillary parameters $\delta$ (misalignment) represents the difference between the radius of the induction base 3 and the radius of the support base 1 ($\delta$=r−_R), and a (effective size of block 6) is the distance measured on a plane perpendicular to the axis of symmetry through point O.

In broad outlines the procedure for obtaining the ideal geometry of the device in relation to the characteristics of the blocks 6 to be handled, is as follows. Starting from a set of variables that we may combine in different ways, each combination will produce a given grip on said block 6, and for every gripping force, therefore, there will be a given minimum value of the coefficient of friction between block 6 and the device, which will represent the ideal model.

This gripping force, however, determines in turn the dimensioning of said device, i.e. the larger the size, the larger the section and the greater the weight required in its component parts, which entails higher manufacturing and operating costs.

On observing the behaviour of this force when altering the different parameters, a significant variation may be seen in respect of value a. This value is no more than an indicator of the effective size of the block 6, or more specifically of the block with respect to the device, in that position in which it is imprisoned by it. Consequently, a single block 6 will have different values of a in accordance with the different positions in which the device may be positioned with respect to said block 6 at the time it is raised. Therefore, for a single block 6, depending on the posture that is adopted, a different force will be applied.

This characteristic means that, for the calculation of the dimensions of the device, the value of the force may be much higher than what is going to be applied in the majority of cases.

For instance, a 5.0×3.0×2.5 m block may be grasped by the same device with different values of a. When this value is the highest possible (which will occur when the block is grasped by the longest side), this force may be, for example, 300 MT, and when the block is grasped by the shortest side this force drops to 60 MT. And in this case, it will be necessary to dimension the whole device for a force of 300 MT, even though this is higher than what is normally going to be applied. And it could be even worse, as a poor choice of the design parameters could mean that the difference between these two extreme values is much higher.

Accordingly, the criterion for obtaining the best combination of parameters that define the device is that the gripping force should be high enough, or what amounts to the same, that the coefficient of friction necessary should be sufficiently low, and essentially, that the variation of this force with respect to the value a or the size if the block 6 should be the lowest possible.

So far the relation between parameters has been described as a purely mathematical development, but certain physical conditions are also involved in this. In fact, there is an obvious relationship between the dimensions of the block 6 and those of the device, which gives rise to certain geometrical restrictions that ensure that the block may be held in the device, to the required extent, together with operating restrictions. For example, the values R and r should be sufficient to house the pulleys; or else the angle formed by the portions AB and OB at the time of grasping the block 6 may not be smaller than a given one.

As examples of the above, in a device suitable for handling blocks of approximately 10 MT, the ideal value for its parameters and wherein N is the number of pulleys intervening in it, is: N=5; R=0.55 m; r=0.43 m; $\delta$=0.12 m; $L_o$=2.19 m; $L_A$=1.19 m; $L_C$=1.53 m; $\alpha$=71°; and P=0.33. Then, the gripping force F exerted for a block with a smallest side of 1.25 m is 17 MT, with a coefficient of friction of 0.59. The gripping force F for a block with a largest side of 2.25 m is 31 MT, with a coefficient of friction of 0.32. Then, the variation in the gripping force will be (31−17)/17, or 82%.

When the device is built for handling blocks of around 90 MT, the preferred value for the device parameters will be: N=4; R=1.20 m; r=1.20 m; $\delta$=0.00 m; $L_o$=4.60 m; $L_A$=2.75 m; $L_C$=3.00 m; $\alpha$=70°; and P=0.33. Then, the gripping force F exerted for a block with a smallest side of 2.50 m is 150 MT, with a coefficient of friction of 0.60. And the gripping force F for a block with a largest side of 5.00 m is 235 MT, with a coefficient of friction of 0.38. Then, the variation in the gripping force will be (235−150)/150, or 56%.

As will be appreciated, the coefficient of friction needed is quite variable in accordance with the type of concrete with which these blocks are made, as well as its state and the shape of the pointed tip 54 of the claw element 5. Nevertheless, a range between 1.0 and 2.0 approximately may be established as a suitable value.

Therefore, in both cases coefficients of safety of 1.6 are obtained in relation to the value of the coefficient of friction in the most unfavourable cases. When taken together with local piercing that can occur from contact of the device with the block, this coefficient proves sufficient.

Furthermore, the variations in the gripping force are minimal in respect of the other geometries. In fact, in the example for the block of 90 MT mentioned above, a device with the parameters N=3; R=1.20 m; r=0.80 m; $\delta$=0.40 m; $L_o$=4.40 m; $L_A$=2.50 m; $L_C$=1.60 m; $\alpha$=80°; and P=0.33 produces a range of gripping forces of 80 MT for the smallest side of the block, and of 250 MT for the largest, while still maintaining a gearing ratio for the pulleys lower than that of the other device. In this case, the variation in grip is 210% and is therefore worse than the previous one, as it would be necessary to dimension it for the greater force, namely 250 MT, when in most cases it was only going to apply 80 MT.

On the basis of the foregoing, it may be established that the qualified ranges in which the different parameters may fluctuate are: for the support base 1 the value of R lies between 0.10 and 2.00 m; for the induction base 3 the value of r is between 0.10 and 2.00 m; the number of pulleys for each of the bases, support 1 and induction 3, is between 2 and 20; the length $L_A$ corresponding to the body portion 51 of the claw element 5 ranges between 0.30 and 4.00 m; the length $L_C$ of the wing portion 52 of said claw element 5 is between 3.00 and 4.00 m; the angle $\alpha$ formed by the alignments AB and BC lies between 25° and 145°; and the length of the arm 4 will be between 0.50 and 5.00 m.

Certain changes, modifications, alterations, substitutions or variations may be added to the mode of embodiment described, as the detail of the foregoing is given for merely illustrative and never restrictive purposes. The intention is that all these changes and other that might occur to persons skilled in the art may be comprised in the invention, providing that they do not go beyond the spirit and broadest scope of the following claims.

We claim:

1. A retractile grab device, suitable for recovering submerged blocks in a marine environment, of an approximate weight between one and one hundred metric tons, comprised of:

a support base member, which is provided with a lower projecting train of a plurality of pulleys arranged in a bank; three pairs of parallel radial lateral projecting flanges, said flanges in equiangular position; and an anchoring means on an upper surface of said support base member;

an induction base member, which is provided with a bearing structure housing an upper projecting train of a plurality of pulleys arranged in a bank and matching up with the bank of pulleys on the support base member, three pairs of radial lateral projecting flanges wherein each flanges is parallel to the other flange of the pair, said flanges in equiangular position, matching up with the pairs of flanges on the support base member and anchoring members arranged on different sides of the bearing structure of the aforesaid upper projecting pulley train;

three straight arm members, suitable for being housed at one of their ends and of pivoting on the pairs of radial flanges of the support base member, and having at their opposite free end a pair of flanges;

three angular claw members comprised of a body portion and a wing portion, each being suitable for connection at the free end of their body portion on a pair of radial flanges of the induction base member, and able to pivot in therein and project the wing portion downwards on the median line plane of the pair of flanges supporting it and having ma end with a pointed shape; and where each angular claw member has means for being held and for pivoting in an elbow portion connected to the free end of the arm member;

at least one pair of cables, associated with a carrier crane or similar driving means, through housed in the support base member and each running from the center of the support base pulley train to an opposite end alternately linking one pulley of the induction base member to one of the support base member, in a helical progression, and being attached finally on a corresponding anchoring arranged on a corresponding side of the bearing structure, in an overall arrangement in the form of a hoist block; and these cables being suitable to support the device statically so that the weight of the induction base of the associated claw members propitiate the movement of the aforesaid induction base away from the support base, and consequently, the pivoting movement of the pointed free end of the wing portion of the claw members away from the axis of the assembly device and due to the restriction of descending movement by swivel anchorage on the end flanges of the arm members; being suitable also for transmitting a progressive fraction force exerted from the carrier crane so that the induction base member is closed up to the support base member and, consequently and with the aid of the weight of the arm members, the pivoting movement of the pointed tips of the wing portion of the claw members towards the axis of the device, so that they imprison the submerged block and keep it firmly grasped until traction force delivered by the cables is greater than resistance offered by the overall weight of the device and of the mass lifted;

a third cable, associated with the carrier crane, attached firmly to a second anchoring means, provided on top of the support base member, suitable for supporting the device statically when so required and as a consequence of the cancellation of the traction force delivered by the cables exerting said traction force, in which case the claw member opening process is reproduced and as a result the release, by gravity, of the lifted mass.

2. A retractile grab device, according to claim 1, suitable fir extracting blocks of between one and one hundred tons in weight, in which a central axis of to device is at a distance between 0.10–2.00 m to a point of connection between the support base member and the urn members; the central axis of said device is at a distance between 0.10–2.00 m to a connection point between the induction base member and the claw members; the number of pulleys for each of the support and induction base members varies from 2–20; the body portion of the claw members has a length between 0.30–4.00 m; the wing portion of the claw members has a length between 0.30–4.00 m; the angle formed between the body and wing portions of the claw members ranges from 25° 145°; and the arm members have a length between 0.50–5.00 m.

* * * * *

UNITED STATES PATENT AND TRADEMARK OFFICE

CERTIFICATE OF CORRECTION

PATENT NO. : 6,824,181 B2
DATED : November 30, 2004
INVENTOR(S) : Samper et al.

It is certified that error appears in the above-identified patent and that said Letters Patent is hereby corrected as shown below:

Column 3,
Line 47, "anointed tip" is corrected to read -- a pointed tip --

Column 6,
Line 57, "having ma end" is corrected to read -- having an end --

Column 6, line 67 to Column 7, line 1,
Is corrected to read: -- and being attached finally on a corresponding anchoring member arranged on a corresponding side of the bearing --

Column 7,
Line 9, "assembly" is deleted to that lines 9-10 are corrected to read: "claw members away from the axis of the device"

Column 8,
Line 8, "fir" is corrected to read -- for --
Line 12, "urn" is corrected to read -- arm --

Signed and Sealed this

Thirty-first Day of May, 2005

JON W. DUDAS
*Director of the United States Patent and Trademark Office*